US008083921B2

(12) United States Patent
Rossi

(10) Patent No.: US 8,083,921 B2
(45) **Date of Patent: *Dec. 27, 2011**

(54) ANODE FOR OXYGEN EVOLUTION

(75) Inventor: Paolo Rossi, Milan (IT)

(73) Assignee: Industrie de Nora S.p.A., Milan (IT)

( * ) Notice: Subject to any disclaimer, the term of this patent is extended or adjusted under 35 U.S.C. 154(b) by 970 days.

This patent is subject to a terminal disclaimer.

(21) Appl. No.: 11/587,842

(22) PCT Filed: May 19, 2005

(86) PCT No.: PCT/EP2005/005453

§ 371 (c)(1),
(2), (4) Date: Oct. 26, 2006

(87) PCT Pub. No.: WO2005/113861

PCT Pub. Date: Dec. 1, 2005

(65) Prior Publication Data

US 2008/0023341 A1 Jan. 31, 2008

(30) Foreign Application Priority Data

May 20, 2004 (IT) ..... MI2004A1006

(51) Int. Cl.
*C02F 1/461* (2006.01)
*B05D 5/12* (2006.01)

(52) U.S. Cl. ..... 205/225; 204/290.03; 204/290.06; 205/759; 427/77

(58) Field of Classification Search ..... 204/290.01–290.14; 205/223–225, 205/275, 759; 427/77
See application file for complete search history.

(56) References Cited

U.S. PATENT DOCUMENTS

| | | | |
|---|---|---|---|
| 5,665,218 | A | 9/1997 | Ashizawa |
| 2004/0031692 | A1 | 2/2004 | Hardee |

FOREIGN PATENT DOCUMENTS

| | | | | |
|---|---|---|---|---|
| EP | 0 531 264 | A | | 3/1993 |
| EP | 0 538 955 | A | | 4/1993 |
| JP | 05230682 | A | * | 9/1993 |
| WO | WO 03/076693 | A | | 9/2003 |
| WO | WO 03/100135 | A | | 12/2003 |

OTHER PUBLICATIONS

Machine translation of JP 05230682 A (1993) Hayashi et al.*

* cited by examiner

*Primary Examiner* — Kaj K Olsen
*Assistant Examiner* — Susan Thai
(74) *Attorney, Agent, or Firm* — Charles A. Muserlian

(57) ABSTRACT

An electrode for high overvoltage oxygen anodic evolution is described comprising a substrate of titanium or other valve metal, a first protective interlayer containing valve metal oxides, a second interlayer containing platinum or other noble metal, and an outer layer comprising tin, copper and antimony oxides. The electrode of the invention may be employed as anode in waste water treatment.

15 Claims, 1 Drawing Sheet

ANODE FOR OXYGEN EVOLUTION

Figure 1:
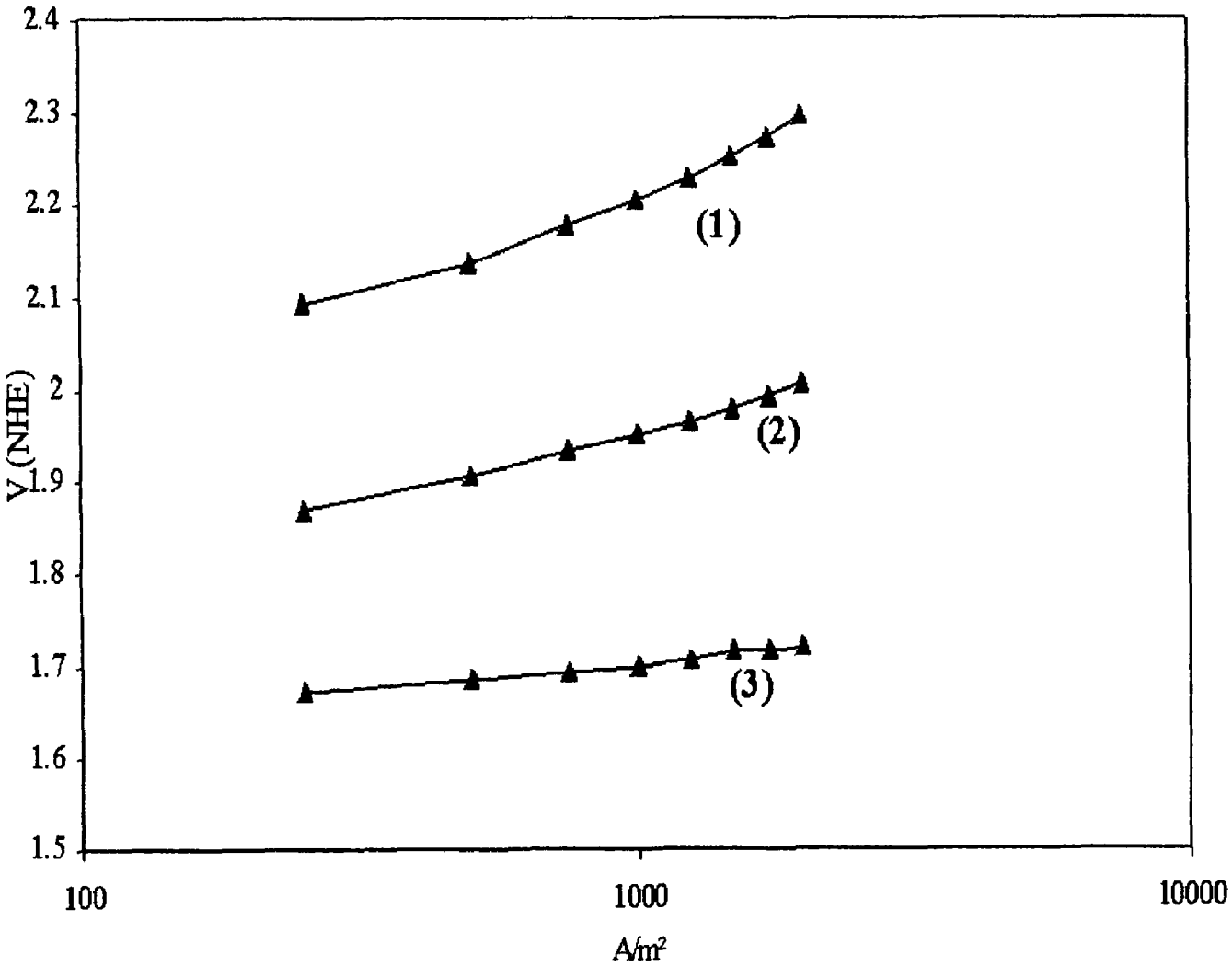

This application is a 371 of PCT/EP2005/005453 filed May 19, 2005

The invention is relative to an anode for high overvoltage oxygen evolution in aqueous solutions, for instance for destroying organics in waste waters. The anodic evolution of oxygen is a very common reaction in generic water treatment, and in particular in waste water treatment when organic or biological substances must be reduced to extremely low levels. The effectiveness of nascent oxygen in destroying organic substances depends primarily on the anodic evolution potential, which must be as high as possible, preferably without requiring the use of excessive current densities. Other industrial processes, for instance in the field of organic electrosynthesis, may take advantage from oxygen evolution at high potential on the anode of the invention, nevertheless the oxidation of organic species in aqueous solutions undoubtedly represents its most widespread and economically relevant use.

The anodes for high overvoltage oxygen evolution of the prior art are traditionally obtained on ceramic substrates, for instance based on tin dioxide variously modified with other elements, mainly in order to impart a sufficient electrical conductivity; also lead dioxide represents a material traditionally employed for this purpose. The geometrical limitations of this type of substrates have led however to the development of electrodes with high oxygen overvoltage based on valve metals, which in the preferred configuration comprise a titanium or titanium alloy substrate, a protective ceramic interlayer, for instance based on titanium and tantalum oxides, and an outer layer of low catalytic activity in which tin dioxide represents again the major component, normally in admixture with other elements such as copper, iridium and antimony; an electrode of this kind, also comprising an intermediate catalytic layer mainly containing tantalum and iridium oxides, is disclosed in example 6 of WO 03/100135. Although the electrode of WO 03/100135 is capable of providing attractive initial performances in the indicated application, as it evolves oxygen at potentials slightly above 2 V with currents of 100 A/m$^2$ in sulphuric solution, its life-time is rather unsatisfactory. In fact, even though the above anode is provided with an outer layer of low catalytic activity, in the normal industrial operating conditions the oxygen evolution potential tends to drop suddenly within a few hundred hours, together with the organic species removal efficiency. Moreover, from the description of WO 03/100135 it can be immediately noticed that the method of preparation of the relevant electrode is rather complex for a large scale production, due to the fact that a high number of alternated layers of two different precursors (in the example, ten alternate layers of two coats each) must be applied.

It is an object of the present invention to provide an oxygen-evolving anode operating at high overvoltage, indicatively higher than 2 V (NHE) at current densities not exceeding a few hundred A/m$^2$, overcoming the limitations of the prior art while presenting a higher life-time in industrial operating conditions.

It is a further object of the present invention to provide a method for the production of a high overvoltage oxygen-evolving anode characterised by an easy industrial applicability.

Under a first aspect, the invention consists of an anode obtained on a ceramic substrate or preferably on a titanium, titanium alloy or other valve metal substrate, comprising a first protective interlayer based on valve metal oxides as known in the art, a second protective interlayer based on noble metals and an outer layer containing tin, copper and antimony oxides.

In one preferred embodiment, the titanium or titanium alloy substrate activated according to the invention is previously provided with an appropriate roughness profile, for instance by sandblasting and subsequent sulphuric acid etching.

In another preferred embodiment, the first interlayer comprises a mixture of titanium and tantalum oxides; in another preferred embodiment, the second interlayer based on noble metals contains platinum, more preferably in an amount comprised between 10 and 24 g/m$^2$.

The outer layer contains tin, copper and antimony oxides, optionally in combination with other elements. The content of tin is preferably comprised between 5 and 25 g/m$^2$, that of antimony between 0.4 and 2 g/m$^2$, and that of copper between 0.2 and 1 g/m$^2$; in a still more preferred embodiment, tin is present in a quantity of at least 90% by weight of the overall metal content.

Under another aspect, the invention consists of a method for the production of a high overvoltage oxygen-evolving anode, comprising the subsequent application of a first protective interlayer based on valve metal oxides, of a second interlayer based on noble metals and of an outer layer containing tin, copper and antimony oxides on a ceramic or valve metal substrate. In one preferred embodiment, the substrate is of titanium or titanium alloy, previously treated in order to impart a suitable roughness profile, for instance by sandblasting followed by sulphuric acid etching, as disclosed in 03/076693. Other types of treatments are possible however, for instance thermal or plasma spray treatments or etchings with other corrosive agents. In one preferred embodiment, the first interlayer is obtained by application of precursors, for example titanium and tantalum chlorides, and subsequent thermal decomposition, for example between 450 and 600° C.; the precursor application may be carried out, as known in the art, by means of different single or combined techniques, such as spraying, brushing or rolling. In one preferred embodiment, the second interlayer is obtained by thermal decomposition of hexachloroplatinic acid at a temperature of 400-600° C., but other forms of noble metal application, for instance via galvanic procedure, can be practiced as well. During the formation of the second interlayer the precursors of other noble metals may be included, but the presence of platinum is particularly preferred.

In one particularly preferred embodiment, the outer layer is applied making use of a single solution containing the precursors of tin, copper and antimony oxides, for instance the relevant chlorides. The solution is applied according to the prior art and preferably decomposed between 450 and 600° C.

The anode of the invention is capable of evolving oxygen at high overvoltage, that is at a potential indicatively higher than 2 V (NHE) at current densities of few hundred A/m$^2$, with largely higher life-times than those of the anode of WO 03/100135 or other anodes of the prior art. Without wishing the present invention to be bound to a particular theory, it can be assumed that, in the case of WO 03/100135, the anode tends to form cracks or fissures in the coating, which uncover some areas, albeit of limited extension, having a high iridium content or in any case a sensibly lower oxygen overvoltage. In the case of the anode of the invention, the possible formation of cracks or fissures would uncover platinum-rich areas, whereon the oxygen overvoltage is still rather high.

Such kind of explanation seems to be substantiated by the data reported in the attached FIGURE.

FIG. 1 shows polarisation curves relative to oxygen evolution on the anode of the invention.

In particular, the curves in FIG. 1 refer to oxygen evolution in sodium sulphate at pH 5 and at 25° C.

(1) indicates the polarisation curve relative to the anode of the invention, (2) the one relative to the anode of the invention provided only with the two interlayers, respectively based on titanium and tantalum oxides and on platinum, (3) the one relative to an anode provided only with the first interlayer based on titanium and tantalum oxides and with an outer layer based on iridium and tantalum oxides. Actually, curve (2) simulates the behaviour of an anode of the invention in which the outer layer based on tin, copper and antimony oxides becomes totally destroyed, while curve (3) simulates the situation of total destruction of the outermost layer of the anode of WO 03/100135.

The invention will be further clarified by the following example, by no means intended to limit the scope thereof, which is solely defined by the appended claims.

EXAMPLE

A titanium sheet grade 1 according to ASTM B 265, of 45 cm×60 cm size and 2 mm thick, was sandblasted with corundum and etched with 25% sulphuric acid containing 10 g/l of dissolved titanium, at a temperature of 87° C. A solution was applied to the sheet containing titanium and tantalum chlorides, at a concentration of 0.11 M Ti and 0.03 M Ta, by electrostatic spraying followed by rolling. Four coats of solution were applied until obtaining a total loading of 0.87 g/m$^2$ of deposit, drying between one coat and the next at 50° C. for 10 minutes, and subsequently carrying out the thermal decomposition at 520° C. for 15 minutes.

A first interlayer was thus obtained, whereon a second interlayer consisting of 20 g/m$^2$ Pt was applied. The application was carried out in three coats, by brushing hexachloroplatinic acid dispersed in eugenol and by thermal decomposition for 10 minutes at 500° C. after each coat.

The outer layer was finally applied starting from a solution of tin (IV) (94% by weight referred to the overall metal content), copper (II) (2% by weight referred to the overall metal content) and antimony (4% by weight referred to the overall metal content) chlorides. The application was carried out by brushing in 16 coats, with cycles of drying at 50° C. and decomposition at 520° C. after each coat.

The electrode of the invention thus obtained was subjected to a polarisation test under oxygen evolution in sodium sulphate at pH 5 and 25° C., and the results are reported in FIG. 1 in the curve indicated as (1). In FIG. 1 are also reported the polarisation data obtained in the same conditions with an equivalent electrode free of outer layer, and with an electrode provided with an equivalent first interlayer, and with an outer layer containing 24 g/m$^2$ of tantalum (35% by weight) and iridium (65% by weight) oxides. Such data are reported in the curves indicated respectively as (2) and (3).

Finally, the electrode of the invention was subjected to an accelerated life-time test in which it was operated under oxygen evolution in sulphuric acid at the concentration of 150 g/l at 60° C. temperature, with a current density of 20 kA/m$^2$.

After 500 hours of accelerated test, its oxygen evolution potential in sodium sulphate at pH 5 and at 25° C. was measured at the current density of 500 A/m$^2$: the detected potential resulted equal to 2.15 V (NHE). An anode prepared in accordance with WO 03/100135, subjected to the same test, showed an oxygen evolution potential of 1.74 V (NHE) at the same conditions.

As it is apparent to an expert in the field, the invention may be practiced making other variations or modifications with respect to the cited examples.

The previous description is not aimed at limiting the invention, which may be used according to different embodiments without departing from the scopes thereof, and whose extent is univocally defined by the appended claims.

Throughout the description and the claims of the present application, the word "comprise" and its variations such as "comprising" and "comprises" are not aimed at excluding the presence of other element or additional components.

The invention claimed is:

1. An anode for high overvoltage oxygen evolution, comprising a valve metal or ceramic substrate, a first interlayer of valve metal oxides applied to said substrate, a second interlayer consisting of platinum applied to said first interlayer, an outer layer consisting of oxides of tin, copper and antimony.

2. The anode of claim 1 wherein said valve metal substrate is made of titanium or titanium alloy.

3. The anode of claim 1 wherein said substrate of titanium alloy has a roughness profile controlled by a treatment comprising a sulfuric acid etching optionally preceded by sandblasting.

4. The anode of claim 1 wherein said first interlayer comprises titanium and tantalum oxides.

5. The anode of claim 1 wherein said second interlayer essentially consisting of platinum comprises 10 to 24 g/m$^2$ of platinum.

6. The anode of claim 1 wherein said outer layer comprises 5 to 25 g/m$^2$ of tin, 0.4 to 2 g/m$^2$ of antimony and 0.2 to 1 g/m$^2$ of copper.

7. The anode of claim 6 wherein tin is present in said outer layer in an amount not lower than 90% by weight of the overall metal content.

8. A method for the production of an anode for high overvoltage oxygen evolution of claim 1, comprising applying a first interlayer based on valve metal oxides to a valve metal or ceramic substrate, applying a second interlayer essentially consisting of platinum to said first interlayer and applying an outer layer consisting oxides of tin, copper and antimony.

9. The method of claim 8 wherein said substrate is a titanium alloy substrate with a controlled roughness profile obtained by sandblasting and subsequent sulfuric acid etching.

10. The method of claim 8 wherein said first interlayer is applied by means of at least one method selected between spraying, brushing and rolling starting from a solution of chlorides of titanium and tantalum, with subsequent thermal decomposition at a temperature comprised between 450 and 600° C.

11. The method of claim 8 wherein said second interlayer essentially consisting of platinum is applied by thermal decomposition of a solution containing hexachloroplatinic acid at a temperature comprised between 400 and 600° C.

12. The method of claim 8 wherein said outer layer is applied in multiple coats starting from a solution containing chlorides of tin, antimony and copper, with subsequent thermal decomposition at a temperature between 450 and 600° C.

13. In an electrochemical process comprising the anodic evolution of oxygen at potential above 2 V (NHE) the improvement comprising using an anode of claim 1.

14. The process of claim 13 comprising the industrial treatment of waters.

15. The process of claim 14 wherein said treatment comprises the elimination of organic molecules from waste waters.

* * * * *